United States Patent [19]

Lohnherr

[11] 4,109,871

[45] Aug. 29, 1978

[54] METHOD AND APPARATUS FOR PROCESSING ABRASIVE MATERIAL

[75] Inventor: Ludger Lohnherr, Oelde, Fed. Rep. of Germany

[73] Assignee: Polysius AG, Neubeckum, Fed. Rep. of Germany

[21] Appl. No.: 752,139

[22] Filed: Dec. 20, 1976

[30] Foreign Application Priority Data

Jan. 8, 1976 [DE] Fed. Rep. of Germany ..... 2600499

[51] Int. Cl.[2] ..... B02C 23/12

[52] U.S. Cl. ..... 241/24; 241/30; 241/80; 241/110

[58] Field of Search ..... 241/79.1, 80, 110, 79, 241/30, 24

[56] References Cited

U.S. PATENT DOCUMENTS

| | | | |
|---|---|---|---|
| 657,933 | 9/1900 | Goth | 241/79 |
| 1,312,658 | 8/1919 | Williams | 241/48 |
| 3,402,895 | 9/1968 | Willmann | 241/80 |
| 3,638,034 | 1/1972 | Romanowski et al. | 241/117 |
| 3,951,347 | 4/1976 | Tiggesbaumker et al. | 241/80 |
| 3,957,212 | 5/1976 | Lohnherr | 241/110 |

*Primary Examiner*—Granville Y. Custer, Jr.
*Attorney, Agent, or Firm*—Jones, Thomas & Askew

[57] ABSTRACT

A method of processing abrasive material, the material being comminuted by means of a roller mill, thereafter sifted in an air separator, and the course material which is collected in the air separation again being comminuted in the roller mill. Furthermore, the invention relates to an apparatus for carrying out said method.

4 Claims, 3 Drawing Figures

METHOD AND APPARATUS FOR PROCESSING ABRASIVE MATERIAL

BACKGROUND OF THE INVENTION

In the comminution of abrasive material, for example in the manufacture of cement and lime, it is generally known to comminute the material to be processed in a roller mill, the comminuted material emerging over the outer peripheral edge of the grinding path then being raised predominantly with the aid of an upwardly rising air flow into an air separator which is accommodated with the roller mill in a common housing and thus joined to said roller mill to form a unit.

It is also already known (U.S. Pat. No. 3,951,347), for processing material to be ground which contains particles which are difficult to grind, to conduct the fine portion of the material comminuted in the roller mill in the aforementioned manner by means of air directly into the air separator provided above the roller mill whereas the coarse material portion falls downwardly out of the mill, and by means of a mechanical raising means is returned to the material entry of the roller mill, previously separating a selectable portion of the coarse material.

In all these known arrangements it has been constantly found in practice that it is very difficult to hold the wear due to the abrasive material within acceptable limits; moreover, for the pneumatic raising of at least the fine material portion from the roller mill into the air separator a considerable amount of energy is always required.

SUMMARY OF THE INVENTION

The invention is therefore based on the problem of providing a method of the type mentioned at the beginning and an apparatus for carrying out said method such that abrasive material can be processed in relatively simple low-energy manner, in particular comminuted, and at the same time the wear on the apparatus parts reduced.

This problem is solved according to the invention substantially in that virtually all of the entire comminuted material is discharged from the roller mill downwardly, mechanically raised and then supplied to the air separator operated separately from the roller mill.

In this method according to the invention the roller mill and air separator are thus separately made and operated. Also of particular importance is that the entire comminuted material is mechanically raised and supplied to the air separator, no pneumatic conveying energy being required to raise ground material from the roller mill to the air separator, considerably reducing the drive energy required.

As has further been found in the extensive tests on which the invention was based, a major part of the wear in the known construction is due to the strong air flow which conveys comminuted material from the roller mill - within a housing — to the air separator. Since this pneumatic raising is omitted in the method according to the invention the part of the wear it causes is obviated.

A further advantage of the invention is also to be seen in that with a separate construction and operating of roller mill and air separator the roller mill need only be relatively simply covered and consequently the installation and removal of the grinding tools is considerably facilitated even in larger grinding units.

A further advantage of the separation in air separator and roller mill is that a normal turbo air separator can be used with which very high finenesses are obtainable. The built-in air separators previously used operate by the air flow principle, i.e. the air flow charged with comminuted material and produced by the system fan is subjected to a sifting operation whereas in the method according to the invention the air flow for the sifting is produced in the separator itself.

An apparatus for carrying out the method according to the invention includes a roller mill, an air separator in communication therewith and a mechanical raising means. Such an apparatus is characterized according to the invention in that the roller mill is connected with the separately arranged air separator on the one hand by a connection of a mill discharge for the entire ground material and the mechanical raising means to the separator material inlet, and on the other by a connection of the separator coarse material discharge to the mill material entry. In this manner a particularly simple constructional form of the roller mill is obtained, above all as regards its housing, and moreover a generally usual air separator may be employed.

Regarding the form of the rolling mill, it is pointed out that roller mills means here mills in which rolling bodies, for example sprung rollers, balls or the like, roll along an annular grinding path; so-called spring roller mills are however preferred.

BRIEF DESCRIPTION OF DRAWING

The invention will be described hereinafter with the aid of the drawings, wherein.

DETAILED DESCRIPTION

Figure 1:
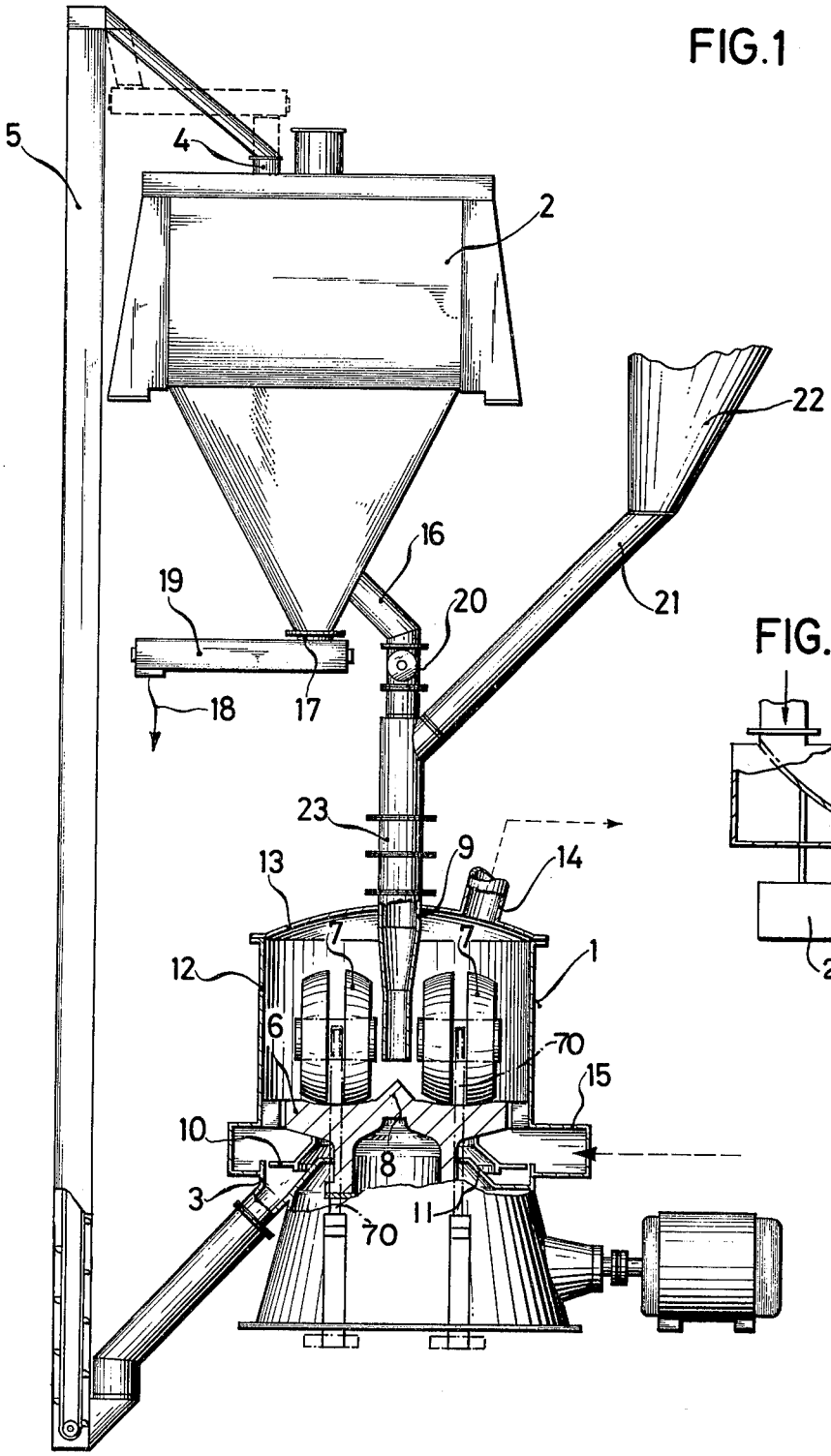
FIG. 1 is a purely schematic overall view of an apparatus for carrying out the method according to the invention with a spring roller mill whose grinding path is not subdivided.

The apparatus illustrated in FIG. 1 comprises a spring roller mill 1, an air separator 2 and a mechanical raising means 5 which connects the mill discharge 3 to the separator entrance 4 and which in this case is formed by a bucket elevator. The spring roller mill 1 and the air separator 2 each form in the apparatus according to the invention a separate constructional unit, the two constructional units being connected together.

In the apparatus illustrated in FIG. 1 a spring roller mill 1 is used which comprises an undivided annular grinding path 6 on which in known manner two diametrically opposite spring roller pairs 7 roll. In the center of the grinding path 6 there is a material distributing cone 8 above which opens a substantially centrally disposed vertical drop tube 9 which forms substantially the mill material entry. In the region below the grinding path 6 a discharge plate 10 rotates, preferably together with the grinding path, and supplies the comminuted material collected by a lower annular dish 11 to the discharge 3. The roller pairs 7 are urged downwardly by spring means 70 which can comprise coil springs or hydraulic cylinders. The spring means 70 straddle each pair of rollers and are anchored on opposite sides of the grinding path.

The spring roller mill 1 includes a housing 12 with a detachable cover 13 covering the entire mill top in which the vertical drop tube 9 is centrally mounted. As further apparent from FIG. 1, the cover 13 comprises an eccentrically disposed air discharge conduit 14 via which used cooling air is carried off (for example to a filter not shown) which is supplied in the region beneath the outer grinding path periphery to the mill, for example via an annular member 15.

Figure 3:
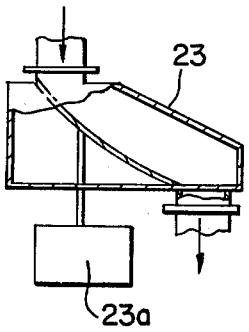
FIG. 3 is a fragmental side view of the proportioning means.

The air separator 2 is of the general type for separating two material fractions and is similar to the air separator described in U.S. Pat. No. 3,901,794 and comprises a coarse material discharge constructed as tube 16 and a fine material discharge 17 from which the fine material is withdrawn as finished material (arrow 18) for example via a conveyor screw 19. The course material discharge 16 communicates with the drop tube 9 of the air separator 1 via an air shut-off member (e.g. cell lock 20). As FIG. 1 further clearly shows, the discharge tube for the coarse material separator is led to a supply tube 21 which proportions the supply of fresh material from a container, hopper or the like 22 to the mill material entry 9, a proportioning means 23 (for example, a magnetic separator or flow meter) being provided above the drop tube 9, as indicated. Various proportioning means can be used to control the flow of material through the supply tube 21, such as the weight and impact detection system 23 of FIG. 3, wherein the weight of the material moving down from the hopper 22 and from tube 16 is detected and the control means 23*a* adjusts the flow of the coarse material in response to the detection of more than or less than the desired flow weight by adjusting the exhaust valve (not shown) of hopper 22. The particular construction of the proportioning system is not a part of this invention.

The drives for the spring roller mill 1, the air separator 2, the bucket elevator 5, etc., may be constructed in usual manner; they are not a feature of the invention and consequently will not be described.

Figure 2:
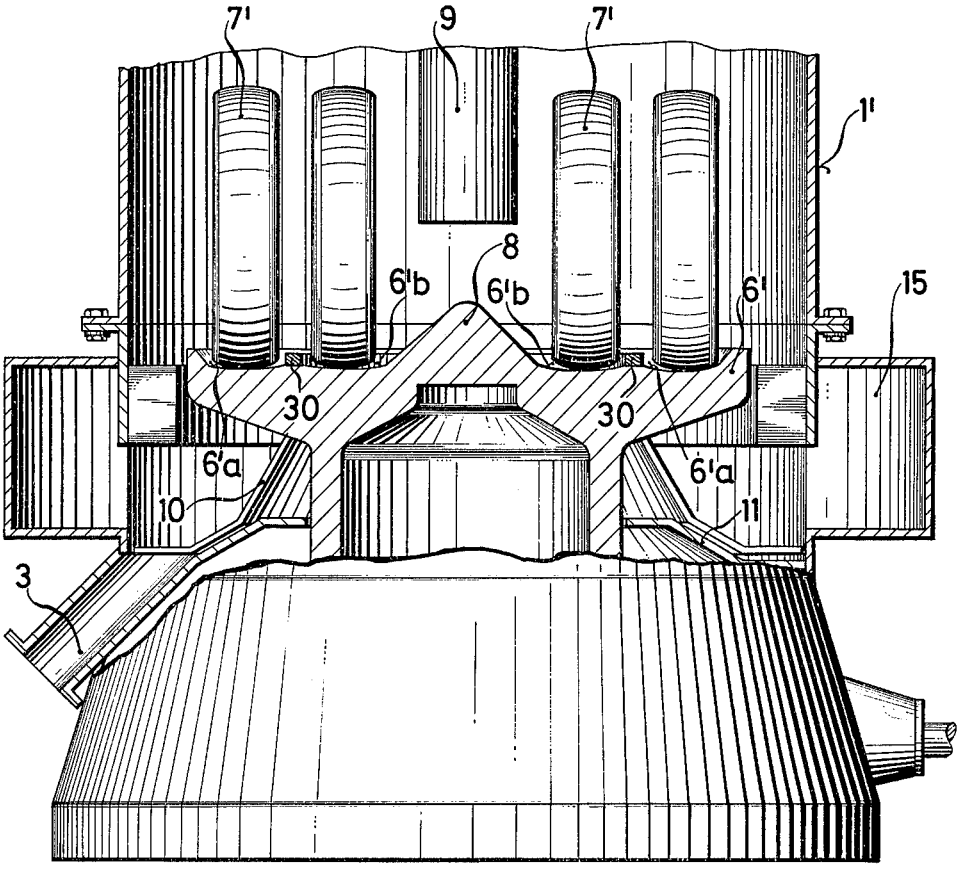
FIG. 2 is a fragmental view of a second apparatus according to the invention comprising a spring roller mill whose grinding path is divided into two concentrically adjacent portions.

Whereas in the embodiment of FIG. 1 the spring roller mill 1 has an undivided grinding path 6, to obtain greater fineness of the grinding it is particularly advantageous if, as illustrated in the schematic fragmental view of FIG. 2, the annular grinding path 6' comprises at least two concentric portions 6'*a* and 6'*b* which in this case lie substantially adjacent each other in a plane, a material dam ring 30 being provided in the transition region of these two grinding path portions and adjustable in its vertical position for example by superimposing a plurality of ring parts. In this manner the residence time of the material on the grinding path 6' and in particular on the two grinding path portions 6'*a* and 6'*b* may be extended in desired manner so that the cooperation of the spring rollers 7' with the grinding path 6' can achieve a particularly high fineness. Preferably, the spring rollers 7' are combined in pairs so that two spring rollers 7' lie diametrically opposite on each grinding path portion 6'*a* or 6'*b*, and in addition the spring roller pairs of the two path portions may be offset with respect to each other by 90°, seen in plan view. All the other parts of this spring roller mill 1' are made in exactly the same manner as in the first example of embodiment and for this reason these parts are also provided with the same reference numerals; it is consequently not necessary to describe them again.

The method of processing abrasive material should be clearly apparent from the preceding description of the two examples of embodiment (with the aid of FIGS. 1 and 2). The material introduced into the spring roller mill 1 is comminuted therein and the entire comminuted material is downwardly discharged through the mill discharge 3. From this mill discharge the comminuted material passes to the bucket elevator 5, is raised by the latter and supplied to the material entry 4 of the air separator 2. In this air separator 2 the comminuted material is then divided into two fractions, of which the coarse fraction is returned via the coarse material discharge 16 to the spring roller mill 1 whilst the fine fraction (arrow 18) is withdrawn via the discharge tube 17 and the conveyor path 19 as finished material. During the comminution cooling air is continuously introduced into the mill 1 or 1' through the tube 15 and, in contrast to known constructions with directly superimposed air separator, pass with relatively low air speed through the mill so that although an adequate cooling is achieved the wear phenomena explained in the known constructions are practically obviated.

The method according to the invention and the apparatus for carrying said method into effect have the following substantial advantages:

- a pronounced reduction of the drive energy (by omission of the pneumatic conveying from the mill to the separator);
- a greater residence time of the material in the mill and thus better comminution which is for example extremely advantageous particularly in grinding clinker (improved strength development of the finished cement);
- lower wear in the roller mill;
- by removing the entire comminuted material via a material discharge of the mill no problems involving grain size distribution (which is very often the case in constructions with pneumatic raising);
- constructional simplification of the apparatus by the use of a conventional commercial separator and by simplified construction of the mill, as well as a considerably simplified installation and removal of the grinding tools;
- since in the mill only a relatively slightly reduced pressure (from the sides of the cooling air) obtains, practically no problems are encountered as regards sealing of the housing;
- finally, it is also possible to introduce cold air for cooling the material into the bucket mechanism and/or the air separator, apart from the mill, or even to provide injection of cooling water in the mill.

While this invention has been described in detail with particular reference to preferred embodiments thereof, it will be understood that variations and modifications can be effected within the spirit and scope of the invention as described hereinbefore and as defined in the appended claims.

I claim:

1. A continuous method of treating abrasive material comprising feeding the material from a supply to a roller mill, grinding the material in the roller mill, discharging both the fine material and coarse material in a downward direction under the influence of gravity from the roller mill, mechanically lifting all of the material discharged downwardly from the roller mill to an air separator, separating fine material from the coarse material in the air separator, discharging the fine material from the air separator and feeding the coarse material from the air separator back to the roller mill while continuing to feed the material from the supply to the roller mill.

2. Apparatus for treating abrasive material comprising a roller mill housing, a roller mill in said housing for grinding the material, coarse material supply means connected to said housing for feeding course material to said roller mill, gravity discharge means for discharging substantially all of the ground material from said housing in a downward direction under the influence of gravity, in air operated material separator above said housing, mechanical lifting means connected between said gravity discharge means and said material separator for mechanically lifting the ground material received from said gravity discharge means to said separator, said separator including a fine material discharge means and a coarse material discharge means, and means for feeding the coarse material from said separator to said housing.

3. Apparatus for processing abrasive material comprising a roller mill, a housing enclosing said roller mill, a vertical drop tube extending downwardly through said housing for delivering abrasive material to said roller mill, a hopper means including an outlet in communication with said vertical drop tube for supplying abrasive material to said roller mill, said roller mill including an annular grinding path divided into two concentric portions, spring rollers disposed diametrically opposite one another in said grinding path portions, the adjacent grinding path portions being separated by a material dam ring, gravity discharge means for delivering substantially all of the ground material from said grinding path in a downward direction, an air separator spaced above said roller mill housing, a mechanical raising means for receiving the ground material from said gravity discharge means and mechanically raising the ground material to said air separator, said air separator including a fine material discharge and including a coarse material discharge in communication with said vertical drop tube, and means for regulating the flow of coarse material from said hopper to said housing.

4. The apparatus of claim 3 and wherein said housing includes a detachable top cover which covers the entire roller mill, with said vertical drop tube extending through said cover.

* * * * *